US007464417B2

(12) United States Patent
Liu

(10) Patent No.: US 7,464,417 B2
(45) Date of Patent: Dec. 16, 2008

(54) PLASTIC SWIMMING POOL WITH ENHANCED STRUCTURE

(75) Inventor: Feng Liu, Shanghai (CN)

(73) Assignee: Bestway (USA) Inc., Carson, CA (US)

( * ) Notice: Subject to any disclaimer, the term of this patent is extended or adjusted under 35 U.S.C. 154(b) by 593 days.

(21) Appl. No.: 11/318,159

(22) Filed: Dec. 23, 2005

(65) Prior Publication Data

US 2006/0162062 A1 Jul. 27, 2006

(30) Foreign Application Priority Data

Jan. 24, 2005 (CN) ..... 2005 2 0002673 U

(51) Int. Cl.
*E04H 4/14* (2006.01)

(52) U.S. Cl. ..... 4/506; 220/613

(58) Field of Classification Search ..... 4/506, 4/513; 220/613, 678

See application file for complete search history.

(56) References Cited

U.S. PATENT DOCUMENTS 5,603,129 A * 2/1997 Chou ..... 4/506
5,652,972 A * 8/1997 Chartrand ..... 4/506
5,736,719 A * 4/1998 Lawson et al. ..... 219/769
5,815,853 A * 10/1998 Chase ..... 4/506
6,571,405 B1 * 6/2003 Saputo et al. ..... 4/506

* cited by examiner

*Primary Examiner*—Tuan N Nguyen
(74) *Attorney, Agent, or Firm*—Finnegan, Henderson, Farabow, Garrett & Dunner, LLP

(57) ABSTRACT

A plastic swimming pool with an enhanced structure comprises a pool wall, a connecting sheet, a base sheet and an inflatable ring, said pool wall is connected with the base sheet via the connecting sheet, the inflatable ring is mounted on a top of the pool wall, said pool wall is formed by connecting a plurality of sidewalls at both sides of them with each other into a loop, the connecting sheet is bonded to the inner side of the lower portion of the pool wall, the connecting sheet is formed by connecting a plurality of material sheets at both sides of them with each other into a loop as well, the welding seams between the sidewalls and the welding seams between the material sheets of the connecting sheet are staggered; the width of an interface for welding the sidewalls and the connecting sheet is more than 80 mm and reinforcing seals are provided in the interface where the sidewalls and the connecting sheet are bonded, and a bottom ring of the connecting sheet is connected directly with the base sheet. The advantage of the present invention is that the reinforcing sheet is integrated with the connecting sheet, meanwhile, the material sheets having reinforcing function become a closed loop around the pool wall, hence, the pool wall is reinforced, the welding seams are protected and possibility of water-leaking is decreased.

3 Claims, 3 Drawing Sheets

PLASTIC SWIMMING POOL WITH ENHANCED STRUCTURE

BACKGROUND OF THE INVENTION

The present invention relates to a plastic swimming pool which can be placed directly in a garden, more specifically, to a plastic swimming pool with a large capacity and an enhanced structure.

Conventional plastic inflatable swimming pool, as shown in FIG. 6, consists of inflatable ring 4, sidewall 1, connecting sheet 2 and base sheet 3, and in some cases, reinforcing sheet 6 at the inner side of the sidewall is bonded to the pool wall for reinforcing it, as shown in U.S. Pat. No. 6,5714,057. The width of an area for welding sidewall 1 and connecting sheet 2 is narrow. This method does not have significant reinforcing function because the reinforcing sheet is not the same material sheet as the connecting sheet leaving a gap therebetween, which has no function for protecting the welding seam connecting the connecting sheet and the sidewall, and the width of an interface for welding the sidewall and the connecting sheet is narrow. After the pool is filled with water, therefore, the narrow welding seam at the lower part of the pool bear very large water pressure, and water-leaking would occur owing to lack of welding firmness. In addition, when reinforcing sheet 6 is welded to the sidewall, the welding seam between the sidewalls are some separated segments, so that reinforcing sheet 6 does not become a closed loop, resulting in poor reinforcing effect for the pool wall (referring to FIG. 6).

SUMMARY OF THE INVENTION

The object of the present invention is to overcome the drawbacks of the prior art. In the present invention, the reinforcing sheet is integrated with the connecting sheet, meanwhile, the material sheets having reinforcing function become a closed loop around the pool wall, hence, the pool wall is reinforced, the welding seam are protected and the drawbacks of the swimming pool of the prior art are overcome. After the pool is filled with water, possibility of water-leaking from the welding seam is greatly decreased.

The invention comprises in structure a pool wall, a connecting sheet, a base sheet and an inflatable ring, said pool wall being formed of flexible PVC plastic material sheets and provided with a reinforcing net therein, the inflatable ring being mounted on a top of the pool wall to support the pool wall, characterized in that said pool wall is formed by connecting a plurality of sidewalls at both sides of them with each other into a loop; the pool wall formed of the sidewalls connected into a loop is connected with the inflatable ring at its top, and is provided with a connecting sheet at the inner side of its lower portion; the connecting sheet is formed by connecting a plurality of material sheets at both sides of them with each other into a loop as well; when the sidewalls are connected with the connecting sheet, the welding seam between the sidewalls are not situated at the same positions as the welding seam between the material sheets of the connecting sheet in a vertical direction, that is, the welding seam between the sidewalls and the welding seam between the material sheets of the connecting sheet are staggered; the width of an interface for welding the sidewalls and the connecting sheet is more than 80 mm and reinforcing seals are provided in the interface where the sidewalls and the connecting sheet are bonded; a plurality of notches of equilateral triangle are cut out in the lower edge of each material sheet of the connecting sheet, and a bottom ring folding inwards which is formed by overlapping and bonding the material sheets of both sides of each notch of equilateral triangle is connected directly with the base sheet through a welding seam.

The present invention has the following advantages. Owing to the fact that water inside the flexible swimming pool with a large capacity applies the largest pressure to the pool wall at the lower-half portion of the pool, in the present invention, an additional width is added to the interface for welding the pool wall and the connecting sheet to reinforce the pool wall at the lower portion of the pool and protect the welding seam; the pool wall and the connecting sheet are connected together through a welding seam with reinforcing seals provided therebetween, increasing the reinforcing effect for the pool wall and the producing efficiency. A plurality of notches of equilateral triangle are cut out in a portion where the connecting sheet is connected with the base sheet, the material sheets at both sides of the notch are bonded through a welding seam, and a reinforcing sheet is used to reinforce the welding seam. In this method, the positions of the welding seam are arranged at the bottom of the pool, so that a part of welding seam are pressed under the bottom of the pool and subjected to less lateral pull-force, meanwhile, the reinforcing sheets are used to make the welding seam not easy to be torn under the action of external force. This kind of swimming pool has simple structure and reliable quality.

In these drawings, 1 denotes sidewall, 2 denotes connecting sheet, 3 denotes base sheet, 4 denotes inflatable ring, 5 denotes reinforcing seals, 6 denotes reinforcing sheet of swimming pool of the prior art.

DETAILED DESCRIPTION OF SPECIFIC EMBODIMENTS

The preferred embodiment of the present invention will be further described with reference to the accompanying drawings.

Figure 1:
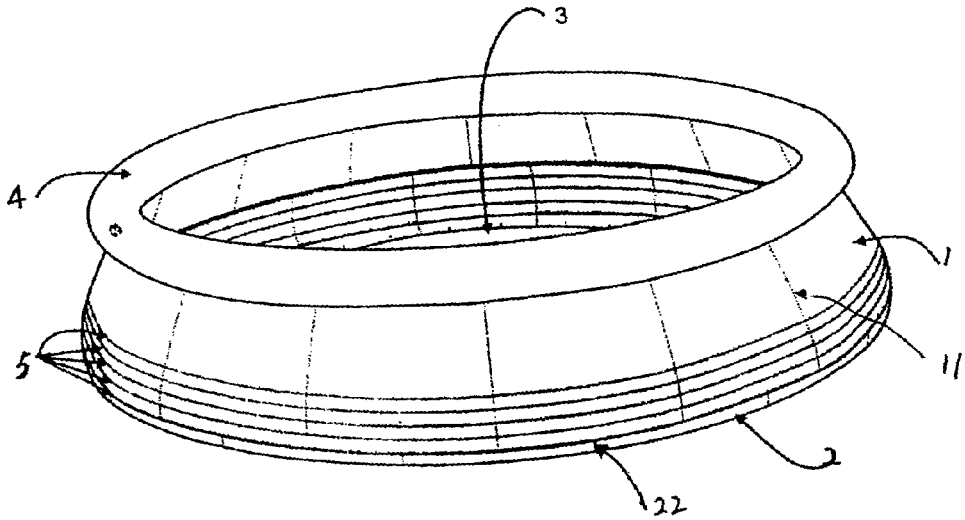
FIG. 1 is a schematic diagram of structure of the present invention.
Figure 2:
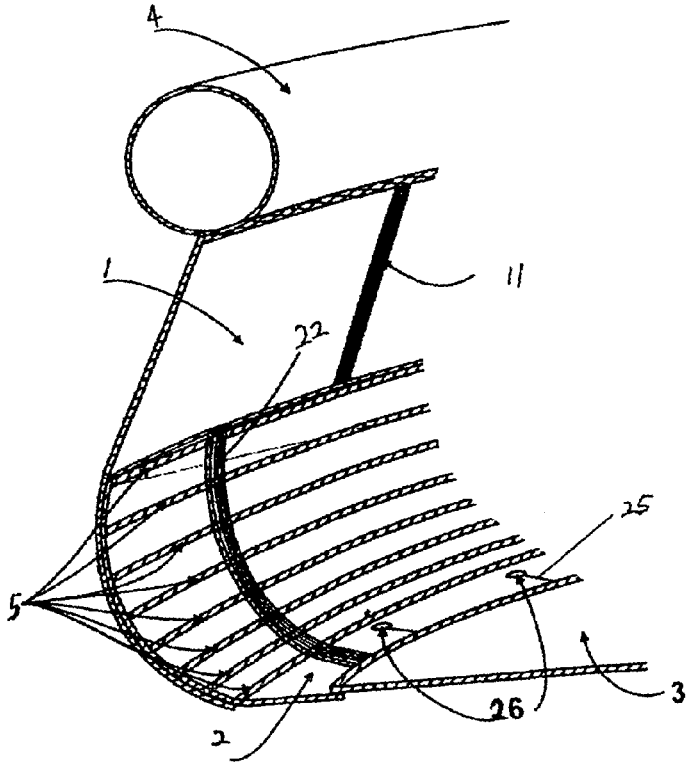
FIG. 2 is a partial section view of structure of the present invention.
Figure 3:
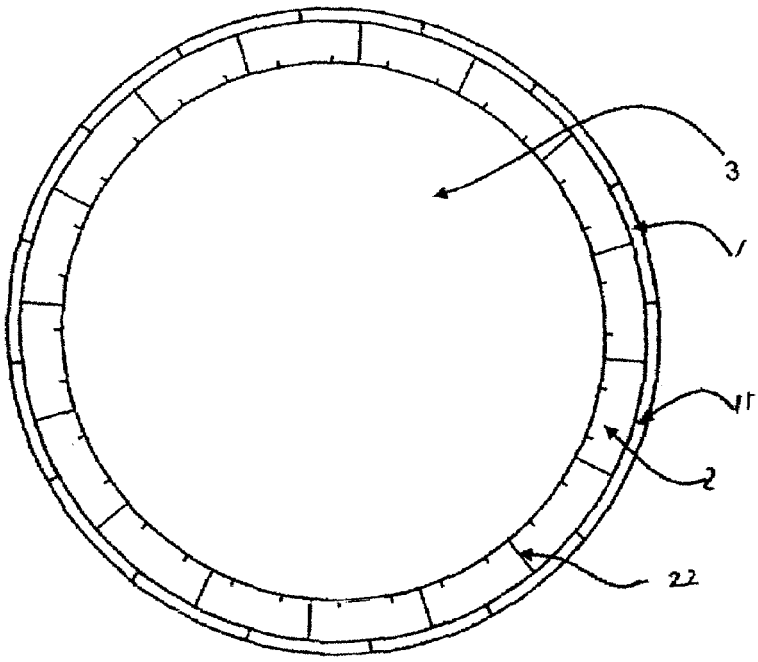
FIG. 3 is a bottom view of the present invention.
Figure 4:
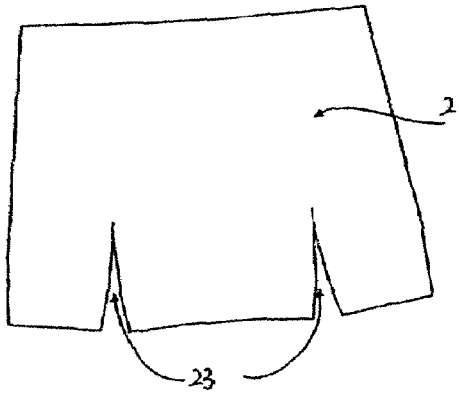
FIG. 4 is a schematic diagram showing that notches of equilateral triangle are cut out in the lower edge of a connecting sheet in the present invention.
Figure 5:
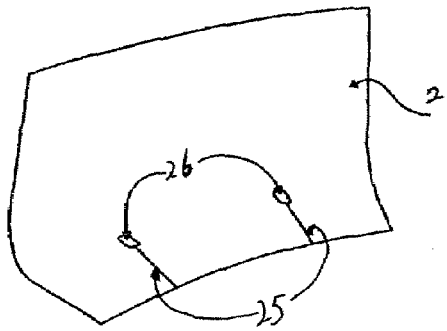
FIG. 5 is a schematic diagram showing that the material sheets of both sides of notches of equilateral triangle cut out in the lower edge of a connecting sheet are overlapped and bonded with reinforcing sheets bonded thereon in the present invention.
Figure 6:
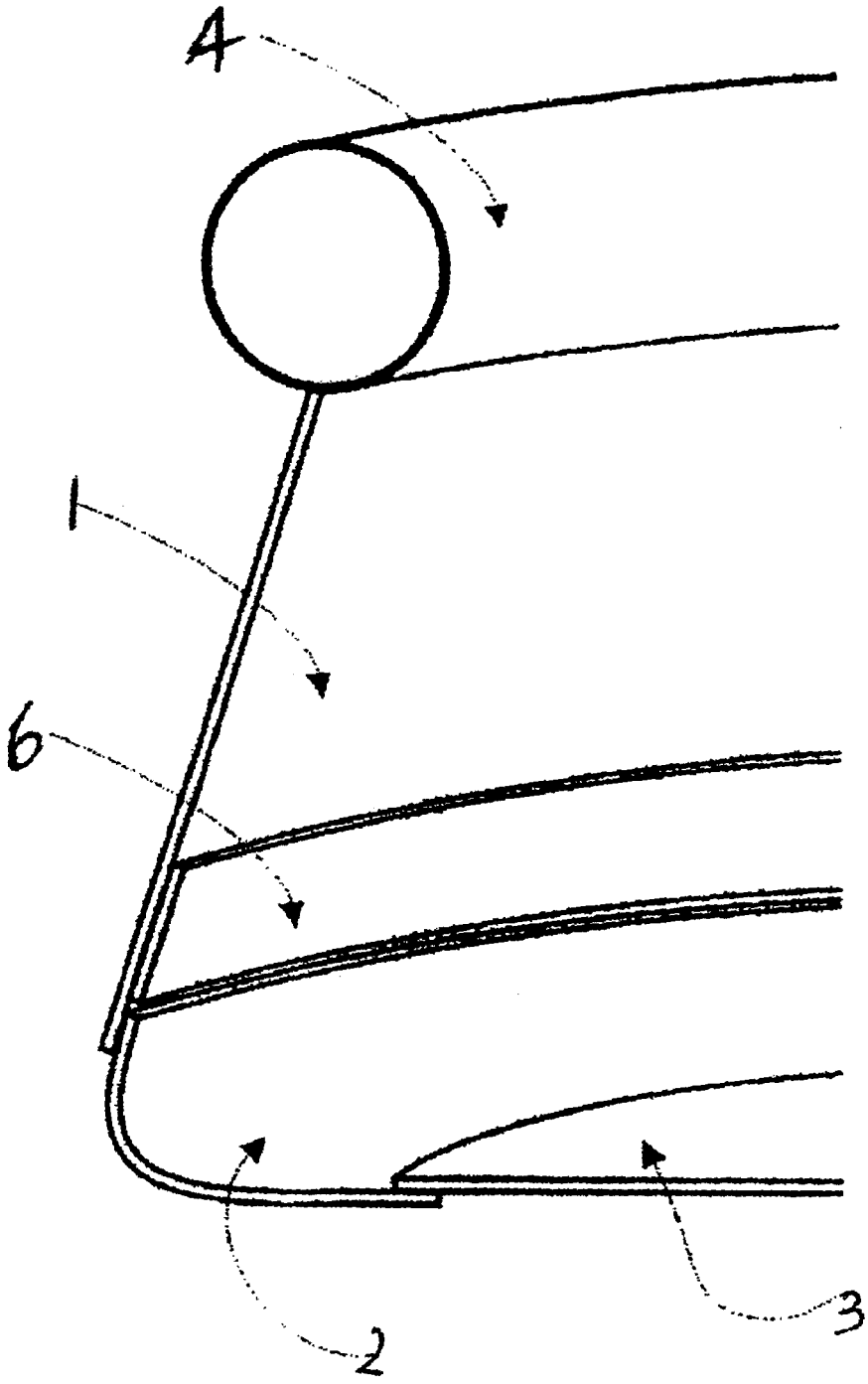
Fig.6 (PRIOR ART)
FIG. 6 is a schematic diagram of structure of swimming pool of the prior art.

As shown in FIGS. 1-5, a pool wall is formed by connecting a plurality of sidewalls 1, which are made of flexible PVC plastic material sheets provided with a reinforcing net therein, at both sides of them with each other into a loop. The pool wall formed of the sidewalls 1 connected into a loop is connected with inflatable ring 4 at its top, and is connected with connecting sheet 2 at the inner side of its lower portion, inflatable 4 being mounted on a top of the pool wall to support the pool wall, and connecting sheet 2 being formed by connecting a plurality of the material sheets at both sides of them with each other into a loop. When sidewalls 1 are connected with connecting sheet 2, the welding seam 11 between sidewalls 1 are not situated at the same positions as the welding seam 22 between the material sheets of the connecting sheet 2 in a vertical direction, that is, the welding seam between the sidewalls and the welding seam between the material sheets of the connecting sheet are staggered. The width of an interface for welding sidewalls 1 and connecting sheet 2 is more than 80 mm. An additional width is added to the interface for welding the pool wall and the connecting sheet to reinforce the pool wall at the lower portion of the pool, the amount of the additional width depending on the capacity of the pool, the larger the capacity the wider the interface for welding the pool wall and the connecting sheet. Hence, quite a wide portion of the connecting sheet covers over welding seam 11 between sidewalls 1 to protect them. A plurality of parallel reinforcing seals 5 are provided in the interface where sidewalls 1 and connecting sheet 2 are bonded to reinforce the sidewalls. Two notches 23 of equilateral triangle are cut out in the lower edge of each material sheet of connecting sheet 2; the material sheets of both sides of each notch 23 of equilateral triangle are overlapped and bonded. In order to protect the welding seam at a notch to prevent water-leaking, reinforcing sheet 26 is provided on top of portion 25 where the material sheets of both sides of a notch of equilateral triangle are overlapped and bonded, because the crossing portion of both sides of a notch are less overlapped when the material sheets of both sides are overlapped and welded. A bottom ring folding inwards is formed at the lower edge of connecting sheet 2 and connected directly with base sheet 3, meanwhile, the welding seam are arranged at the bottom of the pool to release pull-force in a horizontal direction to protect the welding seam. When being used, firstly, inflatable ring 4 is inflated with air and the pool is filled with water. When the pool is filled up with water, sidewalls 1 are pulled upwards in a vertical direction by the upward buoyant force of inflatable ring 4, which makes flexible sidewalls 1 erect and supports the pool wall in a vertical direction, so that the swimming pool is kept in a certain height.

The present invention is directed to provide an economic and reliable solution for outdoor above ground swimming pool with large capacity. Water inside the flexible swimming pool applies the largest pressure to the pool wall at the lower-half portion of the pool, therefore, in the present invention, by increasing the strength of the pool wall, the probability of water-leaking is greatly decreased.

What is claimed is:

1. A plastic swimming pool with an enhanced structure, comprising a pool wall, a connecting sheet, a base sheet and an inflatable ring, said pool wall being formed of flexible PVC plastic material sheets provided with a reinforcing net therein, the inflatable ring being mounted on a top of the pool wall to support the pool wall, characterized in that said pool wall is formed by connecting a plurality of sidewalls at both sides of them with each other into a loop; the pool wall formed of the sidewalls connected into a loop is connected with the inflatable ring at its top, and is provided with a connecting sheet at the inner side of its lower portion; the connecting sheet is formed by connecting a plurality of material sheets at both sides of them with each other into a loop as well; when the sidewalls are connected with the connecting sheet, the welding seams between the sidewalls are not situated at the same positions as the welding seams between the material sheets of the connecting sheet in a vertical direction, that is, the welding seams between the sidewalls and the welding seams between the material sheets of the connecting sheet are staggered; the width of an interface for welding the sidewalls and the connecting sheet is more than 80 mm and reinforcing seals are provided in the interface where the sidewalls and the connecting sheet are bonded; at least one notch is cut out in the lower edge of each material sheet of the connecting sheet, and a bottom ring folding inwards which is formed by overlapping and bonding the material sheets of both sides of each notch is connected with the base sheet through a welding seam.

2. The plastic swimming pool with an enhanced structure according to claim 1, wherein the notch cut out in the lower edge of each material sheet of the connecting sheet is a notch of equilateral triangle, and a reinforcing sheet is provided on top of the portion where the material sheets of both sides of the notch are overlapped.

3. The plastic swimming pool with an enhanced structure according to claim 1, wherein a plurality of parallel reinforcing seals are provided in the interface where the sidewalls and the connecting sheet are bonded.

* * * * *